United States Patent [19]

Pedersen

[11] Patent Number: 4,493,239

[45] Date of Patent: Jan. 15, 1985

[54] RANGE CLEARANCE BY ENHANCING OXIDATION OF FERROUS ORDNANCE IN-SITU

[75] Inventor: Marvin A. Pedersen, Fort Washington, Md.

[73] Assignee: The United States of America as represented by the Secretary of the Navy, Washington, D.C.

[21] Appl. No.: 369,377

[22] Filed: Apr. 19, 1982

[51] Int. Cl.[3] ..... F41F 5/02

[52] U.S. Cl. ..... 89/1.13; 89/1.1; 86/1 B; 102/426; 204/146

[58] Field of Search ..... 89/1 R, 1 M; 102/406, 102/426; 86/1 B; 204/147, 148, 196, 197

[56] References Cited

U.S. PATENT DOCUMENTS

| | | | |
|---|---|---|---|
| 3,265,598 | 8/1966 | Rohrman | 204/148 |
| 3,629,091 | 12/1971 | George | 204/197 |
| 3,869,361 | 3/1975 | Jenkins | 204/197 X |
| 4,169,403 | 10/1979 | Hanson | 86/1 B |
| 4,388,168 | 6/1983 | Burkhart | 204/196 |

*Primary Examiner*—Peter A. Nelson

*Attorney, Agent, or Firm*—Robert F. Beers; Kenneth E. Walden

[57] ABSTRACT

A method of clearing a target range or other area of buried unexploded ordnance (UXO) by advancing natural galvanic electrochemical corrosion whereby ferrous parts of the UXO is simply rusted away at an accelerated rate and rendered harmless within 5 to 10 years in a safe manner and at substantially reduced cost. The electrolytic condition of the soil containing the UXO is preferably enriched. The soil may be saturated with a liberal amount of salt water or other electrolytic chemicals for establishing a corrosive bed several feet below the surface and a dc voltage applied across the soil to enhance stray current corrosion. The galvanic action of the soil electrolyte may be further enhance by elevating its temperature such as by selective covering with black plastic sheets.

17 Claims, 2 Drawing Figures

RANGE CLEARANCE BY ENHANCING OXIDATION OF FERROUS ORDNANCE IN-SITU

BACKGROUND OF THE INVENTION

The invention relates to a method of clearing a target range or other area, such as a war zone, of buried unexploded ordnance (UXO).

The hazards of unexploded ordnance (bombs, artillary shells, rockets, fuzes, etc.) in a war zone are obvious and have to be dealt with in time to avoid risk to life and property. Less obvious are the hazards found in and around military training areas. To enable realistic combat training, live ordnance is necessary. As on the battlefield, a certain percentage of fuzing devices used with the ordnance fail to operate properly, leaving powerful explosive items which could self-initiate at any time due to environmental exposure and shock. The extent of ground penetration of ordnance items depends upon impact velocity, impact angle, weight, and the characteristics of the soil. Usually the heavier items penetrate to greater depths than the smaller items; however, they can be expected at any depth depending on impact and soil.

In time, such live impacted ranges become unfit for combat training due to the density of hazardous items. Eventually it may be desired to return the area to civil or other military use. But, often there are political considerations and it is not an option to merely declare an area "off-limits." The area must be cleared and rendered safe for alternate uses.

Established procedures for clearing areas of such ordnance involve in the main a physical undertaking employing personnel using tools and power machinery. This is both dangerous and expensive, ranging up to as much as $10,000 or more per acre. It is a slow process requiring considerable caution. Generally, a plot of land is marked off in grids and a crew is assigned to a specific grid to walk over it in over-lapping patterns for first clearing the surface. Thereafter, a few inches of the surface soil is removed by powered scrappers and the soil sifted for ordnance. Once this is completed, ordnance teams employ magnetometers and metal detectors to detect and remove ordnance pieces for the next twelve to eighteen inches in depth. The effectiveness of this method is limited, of course, by soil conditions and metal debris. While a magnetometer may detect a metal object in the ground, it can not readily distinguish, for example, shrapnel from ordnance.

It is to these problems that the present invention is directed as a safe and economical method, where time permits, of clearing a range or area of ordnance, some of which is unexploded and may be very unstable to shock or movement.

SUMMARY OF THE INVENTION

The invention is directed to a method of rendering harmless unexploded ordnance in the ground by a process of establishing and maintaining an electrolytic bed in a layer of soil some few feet beneath the surface wherein the UXO lies and imposing a dc voltage thereacross for enhancing stray currents for accelerating natural corrosion for decomposition of the ordnance ferrous and aluminum parts. The surface of the soil may be selectively covered, such as by black plastic sheets, to raise the temperature of the electrolyte bed for enhancing its corrosiveness. Electrolytic decomposition is temperature sensitive, i.e., a higher temperature causes a faster reaction.

It is, therefore, an object of the invention to provide a process for economically and effectively rendering harmless buried unexploded ferrous ordnance by accelerating their corrosive disintegration in the soil.

It is another object of the invention to aid the accelerated corrosion process by maintaining the soil saturated with a moist electrolyte.

It is still another object of the invention to aid the accelerated destructive corrosion process by introducing electrical energy of dc potential into and across the soil at spaced apart locations for establishing stray electrical currents.

It is yet still another object of the invention to aid the accelerated destructive corrosive process by elevating the temperature of the soil.

DETAILED DESCRIPTION OF THE EMBODIMENTS

Figure 1:
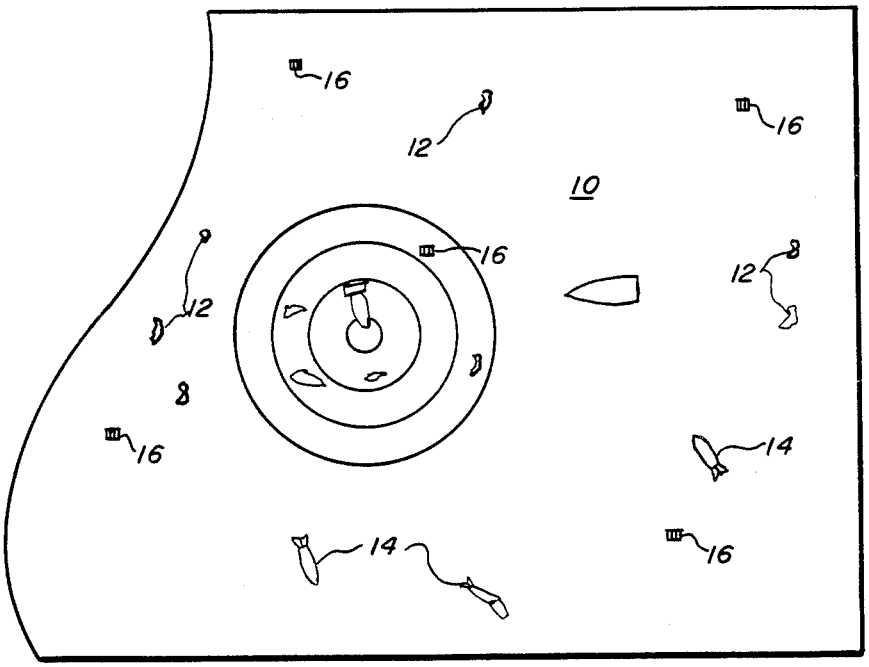
FIG. 1 represents a plot of land previously used as a target range with ordnance and fragments located above and below the ground.

Referring now to the drawings, there is illustrated in FIG. 1 a plot of land 10 to be cleared after having been used as a target range. Most ordnance directed toward the range will have exploded or broken up on impact and fragments 12 found on the surface and at various depths in the soil. Occasionally, however, ordnance pieces 14 such as bombs or shells will penetrate the soil a considerable distance without detonating. This ordnance may still be active, and, may be unstable to shock or movement and capable of much harm to people or property.

Figure 2:
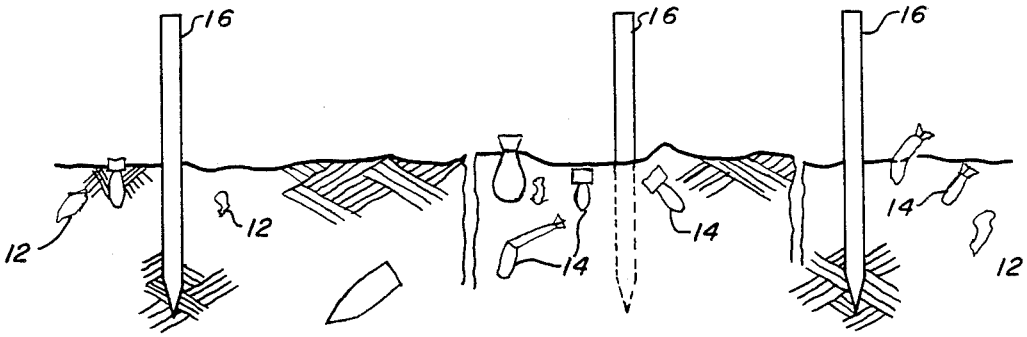
FIG. 2 is a cross sectional view through a typical portion of the soil illustrating ordnance buried therein and the spacing of electrodes.

There is illustrated in FIG. 2 a typical cross-sectional view taken through the soil to illustrate ordnance pieces, both fragments and unexploded, buried at depths a few feet beneath the soil. Electrodes, in the form of posts 16, are illustrated projecting deep into the soil for a purpose to be described more fully hereinafter.

The method taught herein merely enhances the conditions for accelerating galvanic electro-chemical corrosion to destruction of metallic ordnance components in-situ. Where ferrous parts of buried ordnance may naturally oxidize (rust) over a period of several decades, the method disclosed herein eliminates UXO hazards in five to ten years at a substantial reduction in cost and with greater effectiveness in a safe manner. This method is practiced by creating and maintaining high moisture electrolytic conditions (electrolytic bed) in the soil to a depth below the deepest buried UXO. An electrolyte, which must permit the passage of electricity, is briefly defined as a liquid-containing substance which in solution disassociates into free ions. A water solution of numerous chemicals may define an electrolyte which can be used in the present invention to form the electrolytic bed. Sea water, since it normally contains about 3% salt and is plentiful in some areas, may be used as the electrolyte. Quantities of the electrolyte are released on the plot to maintain the soil damp to the desired depth. In areas remote from the sea, an electrolytic bed may be established by adding an oxidizer such as ammonium nitrate to the soil prior to or during continuous saturation with plain water.

To accelerate corrosive action of the electrolytic bed a dc potential may be established across or through the soil containing the UXO. Corrosion of metal is simply a return of it to its natural state, an oxide, and once the process starts it is continuous and irreversible. If a stronger electrical potential is maintained across an electrolyte, corrosive action is enhanced for ferrous and aluminum objects therein. Therefore, it is desired that a dc voltage be introduced into the soil containing UXO, and this is accomplished by inserting posts into the soil to provide electrodes by which the voltage is introduced. These posts may be spaced throughout the plot, and electrical potential established thereacross. The posts may be spaced as much as two or three hundred yards apart across the plot, but it may be found preferable to space them closer together. A continuous dc current is maintained through the electrolytic bed. While the ordnance is not normally in contact with the posts, stray currents passing through the electrolyte will nevertheless introduce currents into the ordnance. Since metallic items constitute a path of least resistance between the electrodes, the DC current will tend to seek these items. With the stray currents passing through the metallic parts of the ordnance in contact with the electrolyte, the ordnance metal tends to go into solution by forming ions. The rate of corrosion is dependent on the amount of current flowing through the metal. It will be obvious that there will be less electrolyte resistance when the electrode posts are closer together, and consequently there will be a greater current flow. Corrosion will take place where the direct current leaves the ordnance item.

Even in the absence of induced DC currents, metal parts making up ordnance will set up local galvanic cells to cause corrosion in the presence of an added electrolyte. Because these metal parts may be shocked from impact, of dissimilar shape or dissimilar composition, a corrosive current flow will be established. Chemicals (e.g. copper sulfate) can even be introduced into the soil that are cathodic to the anodic metals in the UXO in order to promote local galvanic corrosion. Once the metal is corroded from the UXO, explosive trains initially provided therein become disrupted, explosive material becomes exposed to the environment and the UXO hazard is effectively reduced or eliminated.

Maintaining the soil at high temperatures will be advantageous since corrosion is very temperature dependent. This can be accomplished by covering the ground with a black (e.g. plastic) film which collects heat from the sun to raise soil electrolyte bed temperature. This lowers its electrical resistivity, thereby increasing cell activity. The plastic will also serve to trap soil moisture. It may be found advantageous to selectively locate the black coverings over the ground to establish stratification of adjacent cold and warm electrolyte to increase galvanic cell activity.

Once the metals of UXO are corroded away to an oxide, the explosive materials are brought into contact with the soil. While their dangers are now substantially minimized, it may be desirable to introduce bacteria such as those belonging to the genus pseudomas into the soil along with the electrolyte liquid for metabolizing these explosive materials.

While the method of this invention has been shown and described with reference to specific embodiments it will be understood by those skilled in the art that various changes in form and details may be made therein without departing from the scope of the invention which is limited only by the scope of the claims annexed hereto.

What is claimed is:

1. A method of clearing a target range by rendering safe unexploded ordnance buried in the ground comprising the steps of:

adding electrolyte to the soil around buried unexploded ordnance to a depth below the deepest buried unexploded ordnance and maintaining it at a high moisture content for enhancing local galvanic action for accelerating destructive corrosion of metallic parts of the unexploded ordnance; applying direct current voltage through the soil for introducing stray currents therein, and allowing time for destructive corrosion to occur to render the unexploded ordnance safe.

2. The method according to claim 1 further defined by adding a liquid electrolyte to the soil.

3. The method according to claim 2 further defined by adding an electrolyte of sea water to the soil.

4. A method of rendering a plot of ground safe from buried unexploded ordnance comprising: adding electrolyte to the soil around buried unexploded ordnance;

applying a direct current voltage across the soil containing the ordnance for introducing therein stray electrical currents which take paths of lower resistance through metal parts of the ordnance to establish galvanic cells between metals different in the galvanic series to enhance corrosion of that metal which is anodic to which other metal is cathodic.

5. The method according to claim 2 or 3 further defined by applying direct current voltage through the soil for introducing stray currents therein for enhancing the destructive corrosion.

6. The method according to claim 5 further defined by applying the direct current voltage across electrodes within the soil.

7. The method according to claim 6 further defined by applying the direct current voltage across a plurality of electrodes at spaced locations in the ground.

8. The method according to claim 1 further defined by covering areas of the ground with sheet material for retaining moisture within the soil.

9. The method according to claim 5 further defined by covering areas of the ground with sheet material for maintaining moisture within the soil.

10. The method according to claim 6 or 7 further defined by covering areas of the ground with impervious sheet material to hold moisture within the soil.

11. The method according to claim 8 or 9 further defined by covering the area with a generally impervious sheet material of dark color to retain moisture within the soil and to more readily absorb the sun's rays for elevating temperature of the soil.

12. A method of rendering a plot of ground safe from unexploded ordnance buried therein comprising the steps of:

establishing a moisture laden electrolytic bed in the soil to a depth containing unexploded ordnance;

applying a direct current voltage through the electrolytic bed to introduce stray currents to accelerate corrosion by galvanic action of ferrous parts inside the ordnance; and allowing time for corrosion to destruct the ordnance and render the plot safe.

13. The method according to claim 12 further defined by applying sea water to the ground for establishing the electrolytic bed.

14. The method according to claim 12 further defined by applying direct current to the electrolytic bed through groundbed electrodes in the soil.

15. The method according to claim 12, 13 or 14 further defined by covering the ground with a generally impervious sheet means for maintaining moisture within the soil.

16. The method according to claim 15 further defined by covering the ground with sheet means of dark color for more readily absorbing the sun's rays for elevating temperature of the soil.

17. The method according to claim 12 or 13 further defined by adding to the soil a metal which is cathodic to iron for establishing local galvanic cells to favor corrosion of the iron.

* * * * *